US009531137B2

(12) United States Patent
Zhou et al.

(10) Patent No.: US 9,531,137 B2
(45) Date of Patent: Dec. 27, 2016

(54) CABLE CONNECTOR ASSEMBLY HAVING AN LED LAMP EXTENDING THROUGH A HOLE IN A METALLIC SHELL

(71) Applicant: FOXCONN INTERCONNECT TECHNOLOGY LIMITED, Grand Cayman (KY)

(72) Inventors: Zhi-Yong Zhou, Kunshan (CN); Xiao Fan, Kunshan (CN); Jun Chen, Kunshan (CN); Jerry Wu, Irvine, CA (US)

(73) Assignee: FOXCONN INTERCONNECT TECHNOLOGY LIMITED, Grand Cayman (KY)

( * ) Notice: Subject to any disclaimer, the term of this patent is extended or adjusted under 35 U.S.C. 154(b) by 0 days.

(21) Appl. No.: 15/009,848

(22) Filed: Jan. 29, 2016

(65) Prior Publication Data

US 2016/0226199 A1 Aug. 4, 2016

(30) Foreign Application Priority Data

Jan. 29, 2015 (CN) ..... 2015 1 0045127

(51) Int. Cl.
*H01R 3/00* (2006.01)
*H01R 13/717* (2006.01)

(52) U.S. Cl.
CPC ..... *H01R 13/7172* (2013.01); *H01R 13/7175* (2013.01)

(58) Field of Classification Search
CPC ..... H01R 13/717; H01R 13/7172; H01R 13/7175
USPC ..... 439/488–490
See application file for complete search history.

(56) References Cited

U.S. PATENT DOCUMENTS 6,165,006 A * 12/2000 Yeh ..... H01R 13/6641 439/490
6,290,533 B1 * 9/2001 Major ..... H01R 13/652 362/253
6,554,638 B1 4/2003 Hess et al.
7,393,237 B2 * 7/2008 Kuo ..... H01R 13/6691 362/249.01
7,744,231 B2 6/2010 Hutchinson et al.
7,976,336 B2 * 7/2011 Yang ..... H01R 13/6658 439/490

(Continued)

FOREIGN PATENT DOCUMENTS

CN 102761035 B 10/2012
CN 103124031 B 5/2013
EP 2023448 A1 2/2009

*Primary Examiner* — Chandrika Prasad
(74) *Attorney, Agent, or Firm* — Wei Te Chung; Ming Chieh Chang

(57) ABSTRACT

A cable connector assembly comprising: an electrical connector including a plug portion, a printed circuit board (PCB) electrically connected to the plug portion and fixed at a rear end of the plug portion, a Light Emitting Diode (LED) lamp mounted on the PCB, a metal shell enclosing the PCB and having a receiving hole, and an optical element disposed on the plug portion in front of the LED lamp; and a cable electrically connected with the electrical connector; wherein the LED lamp has a curved sidewall facing the optical element and a rear sidewall facing the cable, an upper end of the LED lamp extending through the receiving hole of the metal shell.

20 Claims, 10 Drawing Sheets

(56) References Cited

U.S. PATENT DOCUMENTS

| | | | | |
|---|---|---|---|---|
| 2003/0194906 | A1* | 10/2003 | Arkin | H01R 13/717<br>439/490 |
| 2005/0124209 | A1* | 6/2005 | Currie | H01R 13/7172<br>439/490 |
| 2013/0065444 | A1 | 3/2013 | Bushnell et al. | |
| 2013/0308304 | A1 | 11/2013 | Tuchrelo et al. | |
| 2014/0213100 | A1 | 7/2014 | Xuan et al. | |

* cited by examiner

CABLE CONNECTOR ASSEMBLY HAVING AN LED LAMP EXTENDING THROUGH A HOLE IN A METALLIC SHELL

BACKGROUND OF THE INVENTION

1. Field of the Invention

The present invention relates to a cable connector assembly, and more particularly to a cable connector assembly with an optical element transmitting LED's light.

2. Description of the Related Art

China Patent No. 102761035, issued on Oct. 31, 2012, discloses a cable connector assembly including a terminal module, an internal printed circuit board (PCB), a Light Emitting Diode (LED) on the PCB, a shielding shell enclosing the terminal module and the PCB, a light pipe disposed around the LED and extending through the shell. The light pipe has a protrusion exposing to outside to show the working status of the connector. China Patent No. 103124031, issued on May 29, 2013, discloses a similar cable connector assembly but has an internal PCB and an LED disposed outside of a shielding shell in order not to disturb the shell's shielding effect. US 2013/0065444, published on Mar. 14, 2013, discloses a cable connector assembly comprising an optical element or lens for passing or directing light from a light source. EP 2023448 discloses provision of a holding portion in cooperation with a light pipe to achieve effective shielding.

Therefore, a cable connector assembly having an improved light guide structure is desired.

BRIEF SUMMARY OF THE INVENTION

An object of the present invention is to provide a cable connector assembly with an LED lamp for transmitting light to an optical element effectively.

In order to achieve above-mentioned object, a cable connector assembly comprises: an electrical connector including a plug portion, a printed circuit board (PCB) electrically connected to the plug portion and fixed at a rear end of the plug portion, a Light Emitting Diode (LED) lamp mounted on the PCB, a metal shell enclosing the PCB and having a receiving hole, and an optical element disposed on the plug portion in front of the LED lamp; and a cable electrically connected with the electrical connector; wherein the LED lamp has a curved sidewall facing the optical element and a rear sidewall facing the cable, an upper end of the LED lamp extending through the receiving hole of the metal shell.

Other objects, advantages and novel features of the invention will become more apparent from the following detailed description of the present embodiment when taken in conjunction with the accompanying drawings.

DESCRIPTION OF PREFERRED EMBODIMENT OF THE INVENTION

Figure 1:
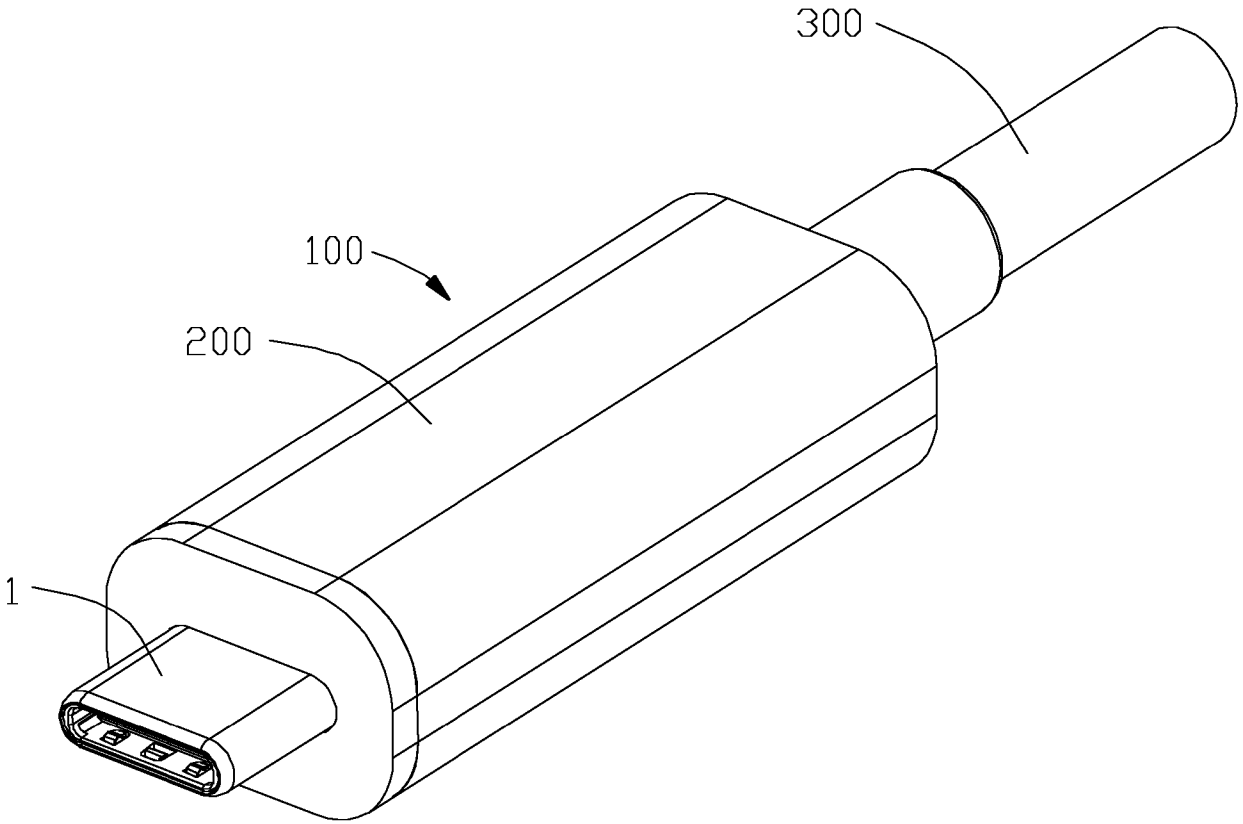
FIG. 1 is a perspective view showing a cable connector assembly in accordance with the present invention.

Reference will now be made to the drawing figures to describe a preferred embodiment of the present invention in detail. Referring to FIGS. 1-6, a cable connector assembly 100 in accordance with the present invention for mating with a mating connector includes an electrical connector 200 and a cable 300 electrically connected with the electrical connector 200. The electrical connector 200 includes a plug portion 1, a printed circuit board (PCB) 2 electrically connected to the plug portion 1, an LED lamp 4 mounted on the PCB 2, an optical element or light waveguide 5 for passing light from the LED lamp, a frame body 6 enclosing the LED lamp 4, a rear metal shell 7 covering a portion of the PCB 2 and the cable 300, and a cover or boot 8 cooperating with the optical element 5 to cover the metal shell 7. The cable connector assembly 100 can be mated with the mating connector in two different orientations to achieve the same function.

Figure 8:
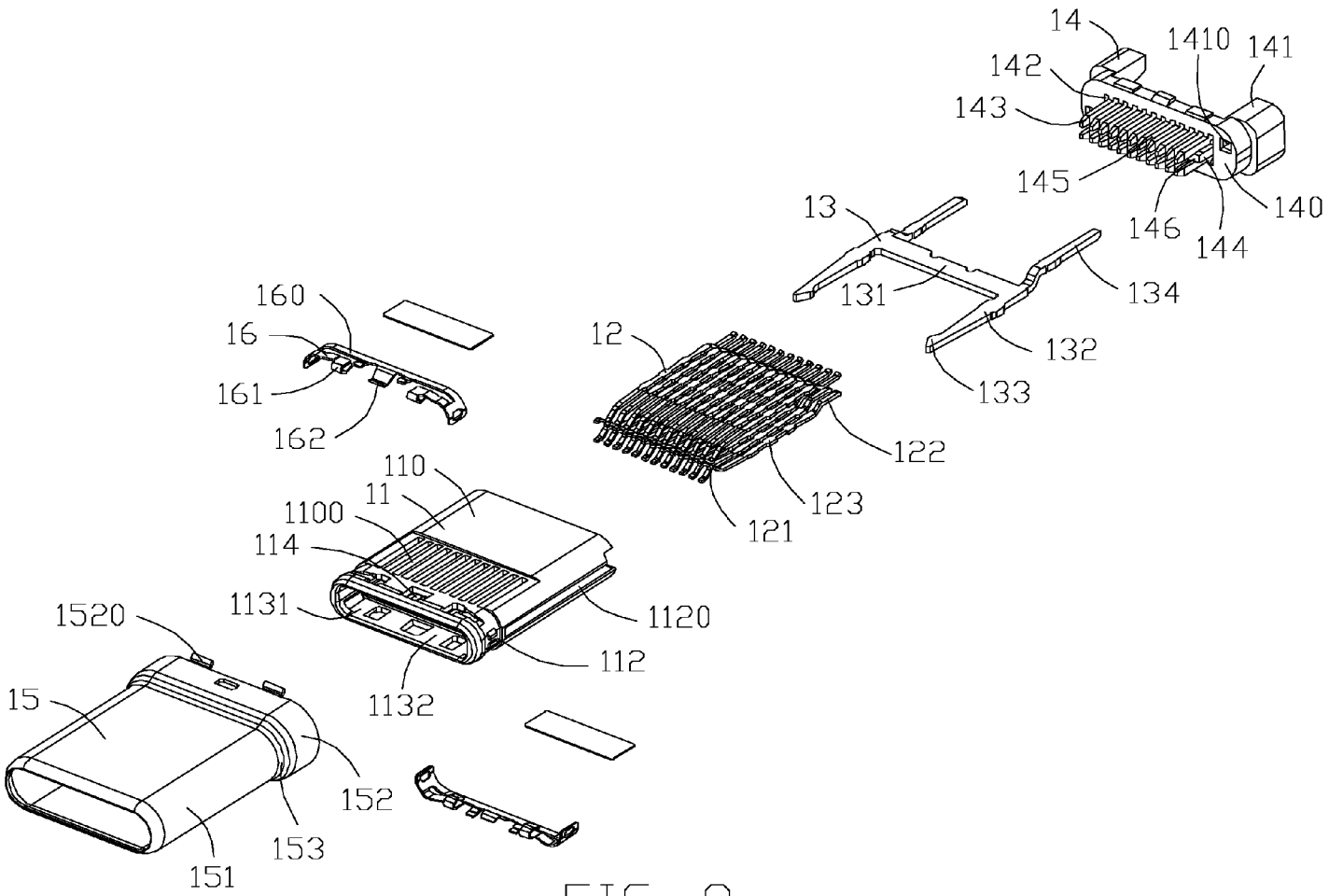
FIG. 8 is an exploded view of the mating member of the cable connector assembly in FIG. 1.
Figure 9:
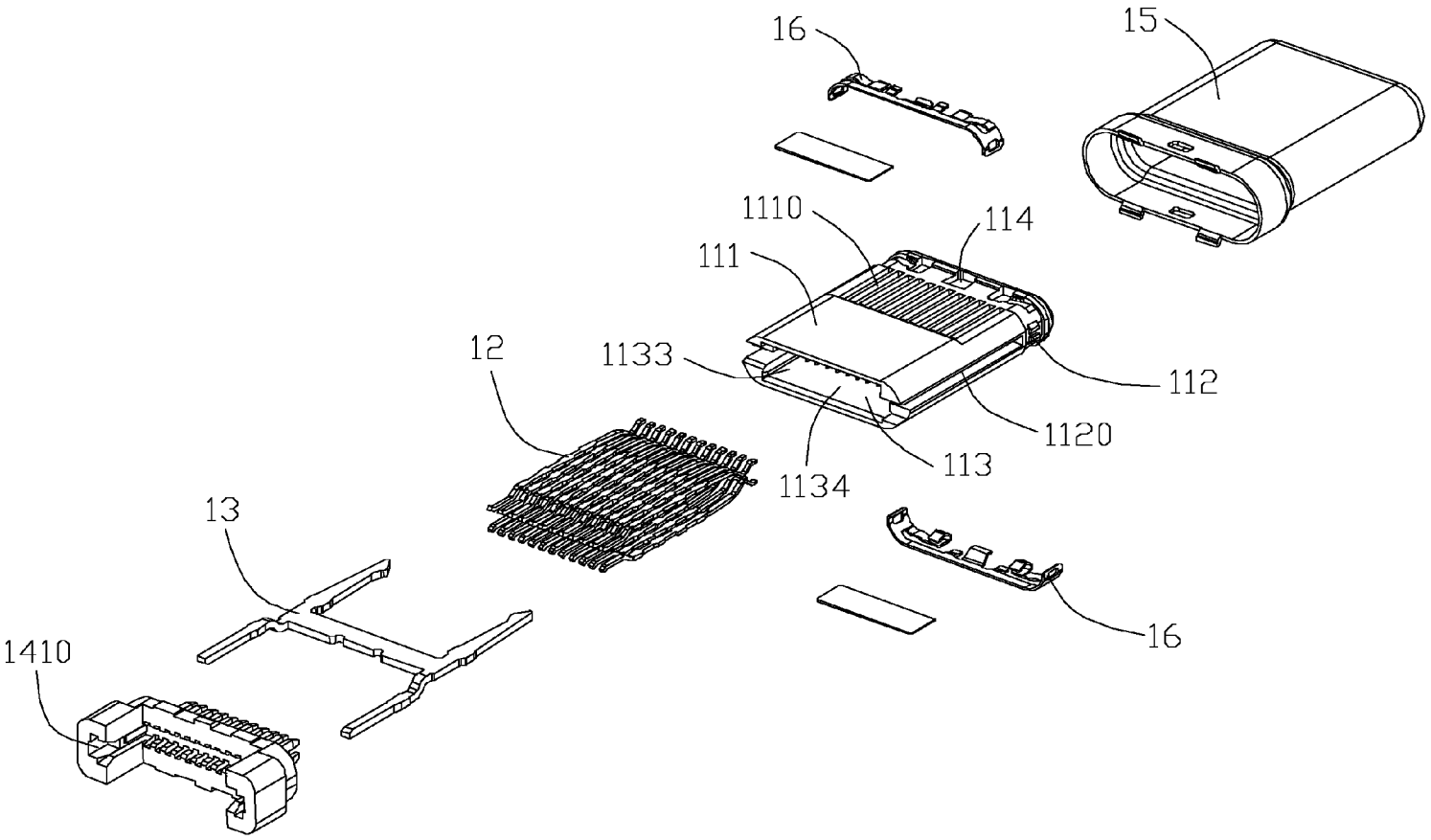
FIG. 9 is an exploded view of the mating member as shown in FIG. 8, but from a different perspective.

Referring to FIGS. 8 and 9, the plug portion 1 includes an insulative housing 11, a plurality of conductive terminals 12 received in the insulative housing 11 and arranged in two rows spaced apart from each other in a vertical direction, a latch 13 disposed between the two rows of conductive terminals 12 for latching with the mating connector, an insulative member 14 disposed behind the insulative housing 11, a front metallic mating shell 15 disposed outside of the insulative housing 11 and the insulative member 14, and a pair of grounding members 16 disposed on the insulative housing 11 and electrically connected to the metal shell 15.

The insulative housing 11 includes a top wall 110, a bottom wall 111 spaced apart from and parallel to the top wall 110, a pair of side walls 112 connecting the top wall 110 and the bottom wall 111, and a receiving space 113 surrounded by the top, bottom, and side walls. The receiving space 113 is divided into a front portion 1132 having a front opening 1131, and a rear portion 1134 having a rear opening 1133. The top wall 110 defines a top slot 1100 in communication with the front portion 1132. The bottom wall 111 defines a bottom slot 1110 in communication with the front portion 1132. Each of the side walls 112 defines a side slot 1120 extending forwardly from a rear end of the insulative housing 11 up to a front end of the insulative housing 11. The side slots 1120 are in communication with the front portion 1132 and the rear portion 1134 of the receiving space 113. There are a plurality of recess 114 defined in front of the top wall 110 and the bottom wall 111 of the insulative housing 11.

Each of the terminals 12 defines a front mating portion 121 extending forwardly into the front portion 1132 of the receiving space 113, a rear mating portion 122 extending rearwardly, and an intermediate retaining portion 123 secured to the insulative housing 11. The front mating portion 121 is to be mated with the mating connector and the rear mating portion 122 is to be mated with the PCB 2. The front mating portions 121 of the two rows of terminals 12 are arranged face to face along the vertical direction.

The latch 13 includes a base portion 131 extending along a transverse direction, a pair of latch beams 132 respectively extending forwardly from two opposite ends of the base portion 131, a pair of latch portions 133 extending from front end of the latch beams 132 along a face to face direction and a pair of extending beams 134 respectively extending rearwardly from two opposite ends of the base portion 131. One of the extending beams 134 is located above the plane of the base portion 131 and the other is located below the plane of the base portion 131. The latch 13 is mounted into the insulative housing 11 through the rear opening 1133 of the rear portion 1134 of the receiving space 113. The latch beams 132 are received into the side slots 1120, respectively. At least a portion of each of the latch portions 133 projects into the front portion 1132 of the receiving space 113. The pair of latch portions is arranged face to face along the transverse direction.

The insulative member 14 cooperates with the insulative housing 11 to fix the latch 13. The insulative member 14 includes an insulative base portion 140, a pair of extending portions 141 extending rearwardly from two opposite ends of the insulative base portion 140, two rows of through holes 142 spaced apart in the vertical direction and extending through the insulative base portion 140 along a front to rear direction, two rows of posts 143 spaced apart in the vertical direction and extending forwardly from the insulative base portion 140, and a projected portion 144 extending forwardly between the two rows of posts 143. A channel 145 is formed between every two adjacent posts 143 of each row and is in communication with a corresponding one of the through holes 142. Each of the extending portions 141 defines a mounting slot 1410 extending along a rear to front direction. The posts 143 extend forwardly beyond the projected portion 144. A receiving slot 146 is formed between the two rows of posts 143. The insulative base portion 140 is thicker than the insulative housing 11. The insulative base portion 140 extends outwardly with respect to the top wall 110 and the bottom wall 111 after the insulative member 14 is mounted to the insulative housing 11 along a rear to front direction. The base portion 131 of the latch 13 is received into the receiving slot 146 of the insulative member 14, the projected portion 144 is pressed against a rear side of the base portion 131, and the pair of extending beams 134 are extending into the corresponding mounting slots 1410. The rear mating portions 122 of the terminals 12 extend through the insulative member 140 by passing the channels 145 and the through holes 142, respectively. Each of the extending beams 134 defines a projection 1411.

The mating shell 15 has a closed circumference that has a good seal performance, a good anti-EMI performance, etc. The closed circumference of the mating shell 15 could be manufactured by drawing a metal piece, bending a metal piece, die casting, etc. The mating shell 15 includes a first front end 151 for being inserted into the mating connector, a first rear end 152, and a first transition portion 153 for connecting the first front end 151 and the first rear end 152. A diametrical dimension of the first front end 151 is smaller than the diametrical dimension of the first rear end 152. The first rear end 152 defines a plurality of latch tabs 1520 projecting outwardly.

One of the grounding members 16 is received on the top slot 1110, and the other one is received on the bottom slot 1110. Each of the grounding members 16 includes a grounding body portion 160, a pair of grounding tabs 161 extending from two opposite ends of the grounding body portion 160 and toward the insulative housing 11, and a contacting tab 162 extending forwardly from a front side of the grounding body portion 160 and entering into the front portion 1132 of the receiving space 113. The grounding tabs 161 and the contacting tab 162 are receiving into the recesses 114 of the insulative housing 11, and the contacting tab 162 is used for mating with the mating connector. The contacting tabs 162 of the pair grounding members 16 are disposed face to face along the vertical direction. A distance along the vertical direction between the contacting tabs 162 of the pair of grounding members 16 is greater than a distance along the vertical direction of the front mating portions 121 of the two rows of terminals 12.

Figure 4:
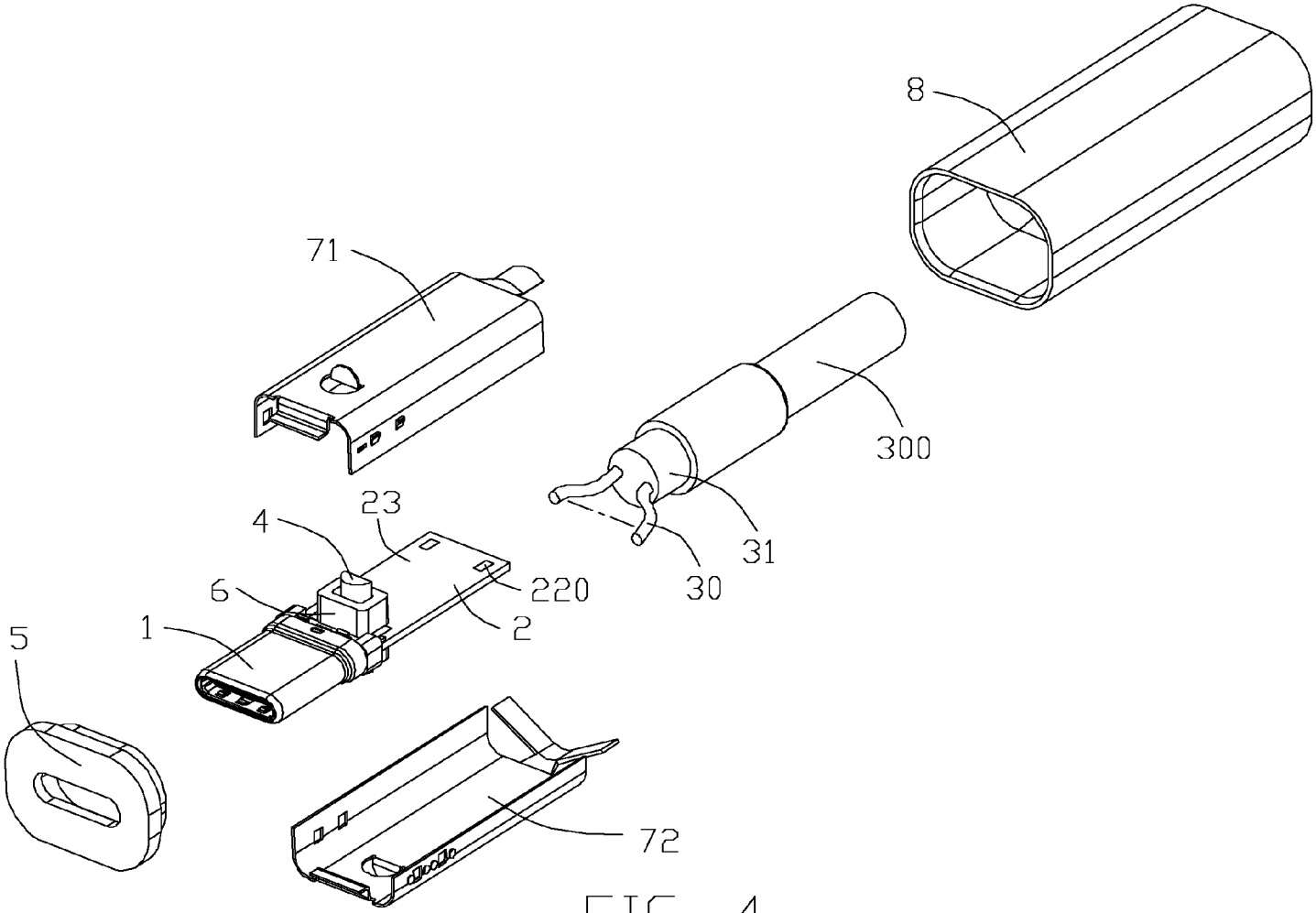
FIG. 4 is another partially exploded view of the cable connector assembly in FIG. 3 from a different perspective.
Figure 5:
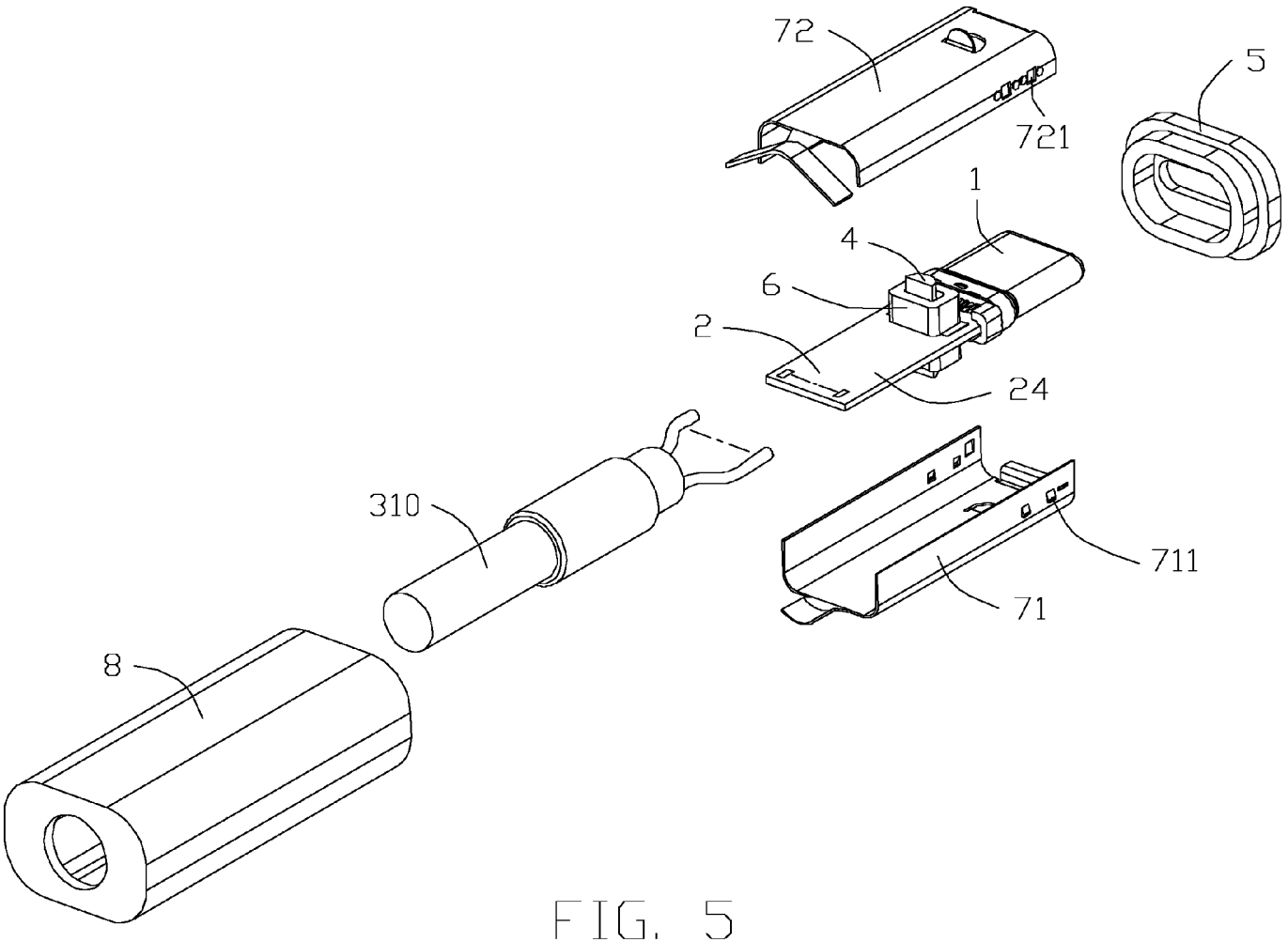
FIG. 5 is a view similar to FIG. 4, but from a different perspective.
Figure 6:
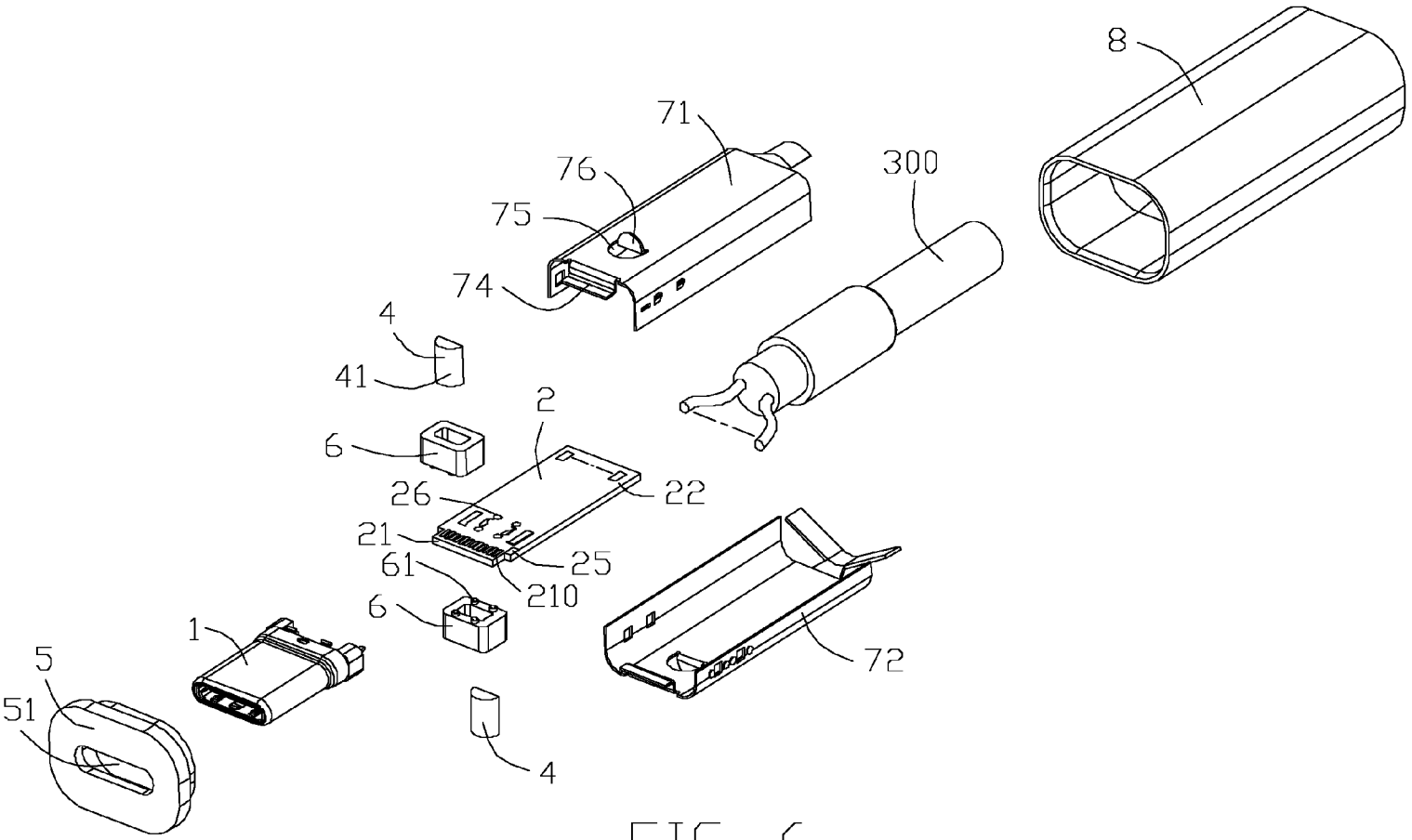
FIG. 6 is an exploded view of the cable connector assembly in FIG. 1 omitting a mating member thereof.
Figure 7:
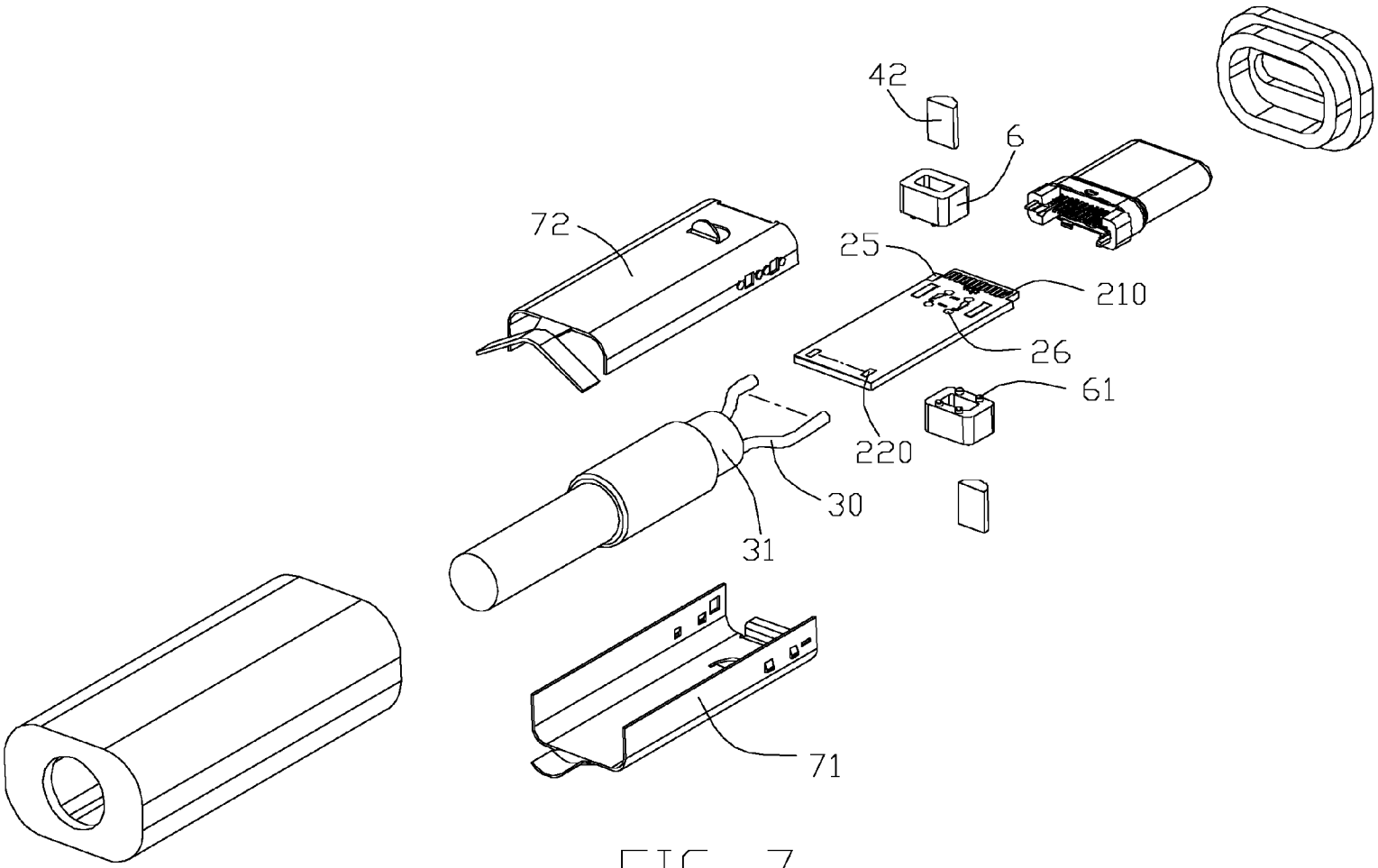
FIG. 7 is an exploded view similar to FIG. 6, but from a different perspective.

Referring to FIG. 4 and FIG. 7, the PCB 2 is disposed between the plug portion 1 and the cable 300. The cable 300 is electrically connected with the terminals 12 by the PCB 2. The PCB 2 includes a front end portion 21, a rear end portion 22, an upper surface 23 and an opposite lower surface 24. The upper and the lower surface of the front end portion 21 define a plurality of front conductive pads 210 connected with the rear mating portion 122 of the terminals 12, while the lower surface of the rear end portion 22 define a pair of rear conductive pads 220 connected to the cable 300. The dimension of the front end portion 21 of PCB 2 is smaller than the dimension of the rear end portion 22 of PCB 2, the dimension of the rear conductive pad 220 is larger than the dimension of the front conductive pad 210. Each of the upper surface 23 and the lower surface 24 defines a metal bar 25 used for the corresponding extending beam 134 of the latch 13 being soldered in order to strengthen fixing of the latch 13. The front end portion 21 is disposed between the rear mating portions 122 of the upper and lower terminals 12, and the rear mating portions 122 are electrically connected to the corresponding front conductive pads 210.

The cable 300 includes a plurality of core wires 30 and an insulative layer 31 covering the core wires 30.

In the present embodiment, light emitted by the LED lamp 4 is parallel to the PCB 2. The light emitted by a portion of the LED lamp 4 exposed outside the metal shell 7 passes through the optical element 5 to form a continuous aperture. The LED lamp 4 includes a curved sidewall 41 facing an inserting direction and a vertical sidewall 42 facing the cable 300. The light emitted from the curved sidewall 41 of the LED lamp 4 is distributed along the inserting direction and received by the optical element 5 evenly. The LED lamps 4 are symmetrically arranged on the upper surface 23 and lower surface 24 of the PCB 2, which makes light passing the optical element 5 more evenly.

The optical element 5 is annular and has a closed circumference, and includes a through hole 51 to let the first front end 151 to pass through, thereby the optical element 5 is telescoped on the mating shell 15, with the through hole 51 bearing against the first transition portion 153.

The enclosed frame body 6 is received in the metal shell 7. The LED lamps 4 are surrounded in the enclosed frame body 6 to reduce the diffraction of the light emitted from the sidewalls of the LED lamps 4, which can also plays a role in protection. A number of mounding posts 61 are defined on a bottom wall of the enclosed frame body 6, and received in corresponding mounting holes 26 to fix the enclosed frame body 6 on the PCB 2.

Figure 2:
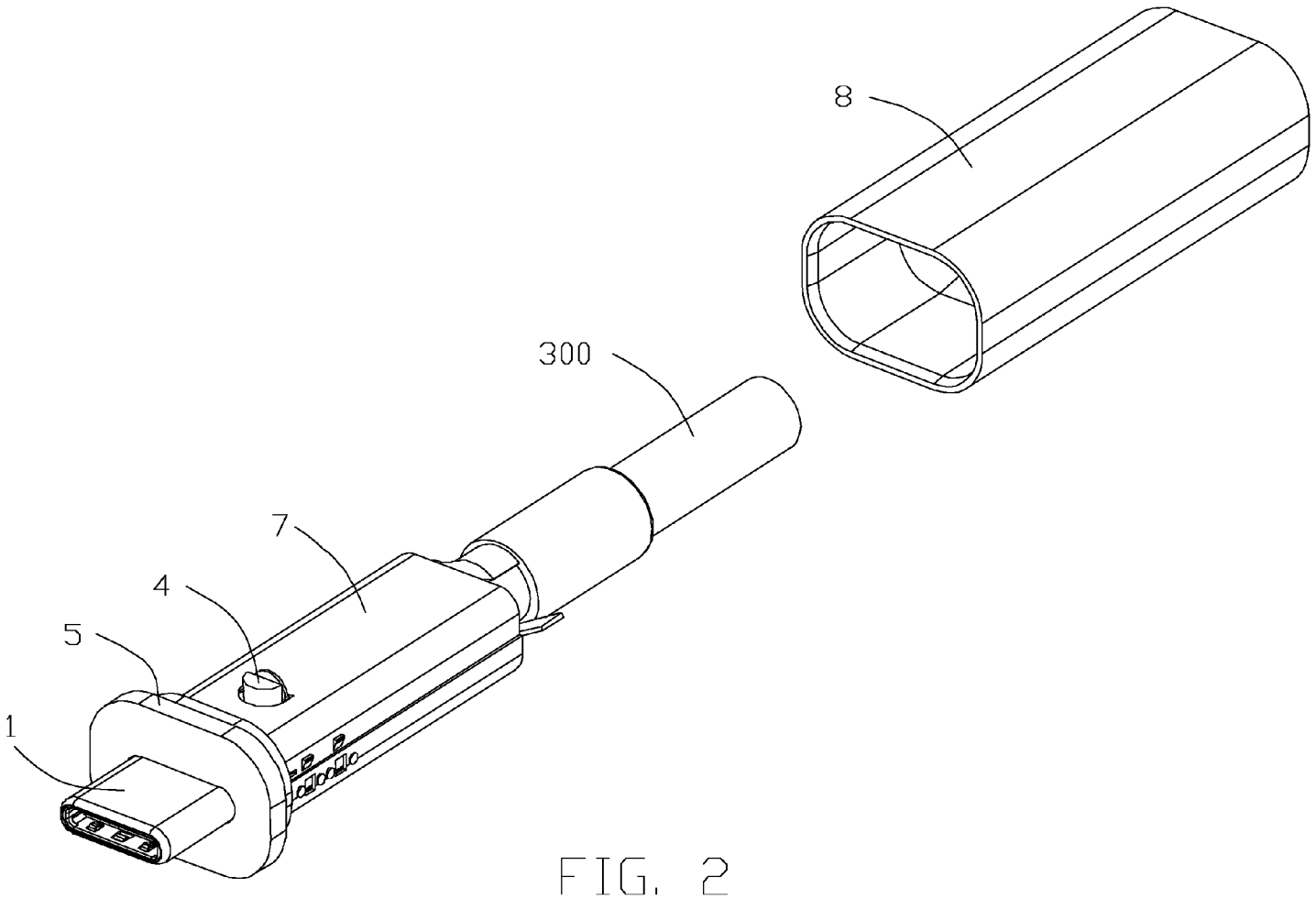
FIG. 2 is a partially exploded view of the cable connector assembly in FIG. 1.
Figure 3:
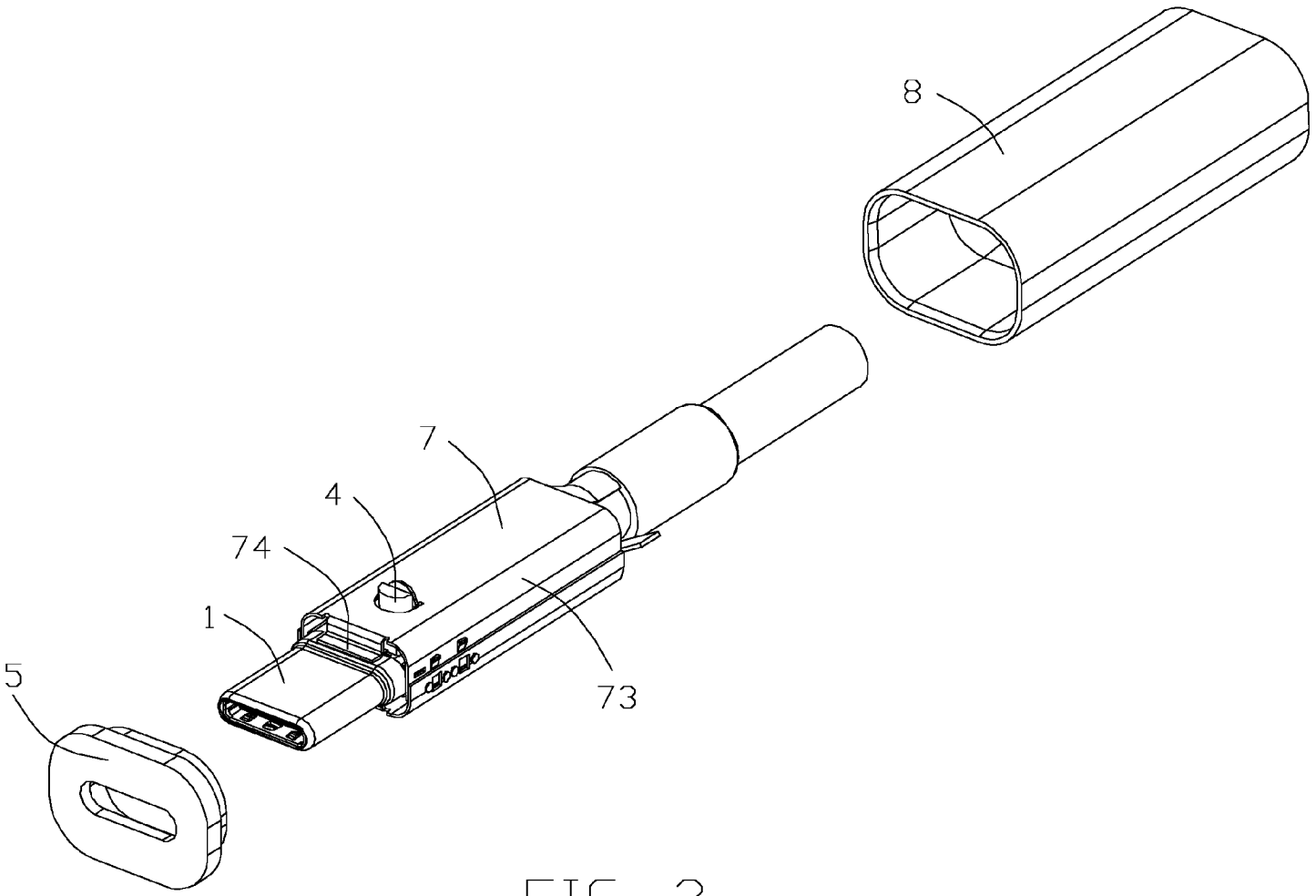
FIG. 3 is a further partially exploded view of the cable connector assembly in FIG. 1.
Figure 10:
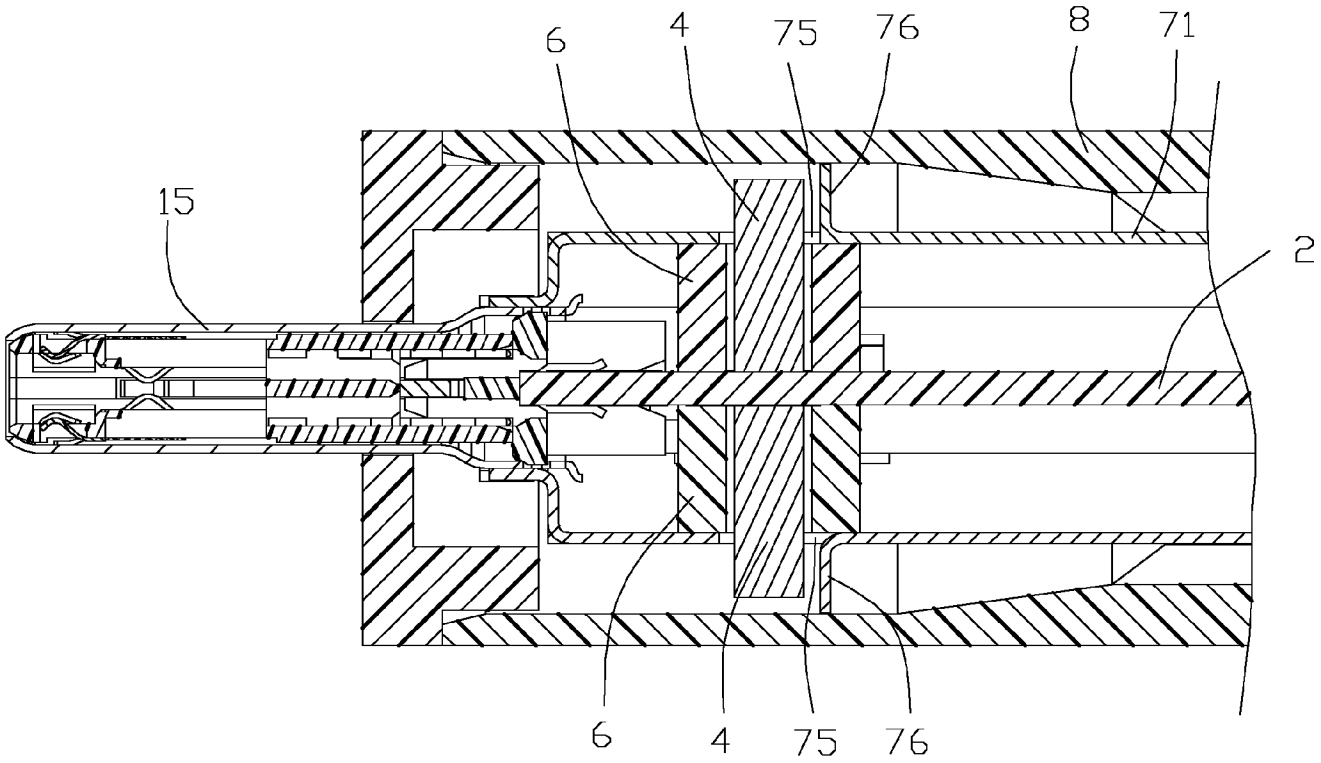
FIG. 10 is a cross-sectional view of the cable connector of FIG. 1.

Referring particularly to FIG. 2 and FIG. 7, the metal shell 7 includes a first shell 71 and a second shell 72 mating with each other, each of the first shell 71 and the second shell 72 defines a main portion 73 and a tongue portion 74 extending forwardly from the main portion 73. In this embodiment, the tongue portion 74 is fixed to the first rear end 152 by soldering, in other embodiments, the tongue portion 74 can be fixed to the first rear end 152 by gluing or other manners. The opening 75 makes the LED lamp 4 facing to the optical element 5. The first shell 71 defines a plurality of latch tabs 711 disposed on both sides thereof and the second shell 72 defines a plurality of latch holes 721 disposed on both sides thereof, the first shell 71 is fixed to the second shell 72 by the latch tabs 711 being retained in the corresponding latch holes 721. Each of the first shell 71 and the second shell 72 defines a receiving hole 75 to let the corresponding LED lamp 4 exposed from the metal shell 7. The receiving holes 75 are consistent with the peripheral shape of the LED lamps 4. A light barrier 76 is bent to form on a rear portion of the metal shell 7 behind each receiving hole 75. With reference to FIG. 10, the light barrier 76 extends into the space (not labeled) between the shell 7 and the cover 8. The light emitted by the vertical sidewalls 42 of the LED lamps 4 is forwardly transmitted into the optical element 5 along the inserting direction after reflected by the corresponding light barrier 76, thereby the intensity of the light revealed by the optical element 5 is enhanced.

The assembling process of the cable connector assembly 100 is as follows, firstly the mating member 1 and the PCB 2 are provide. The LED lamps 4 are mounted on the upper surface 23 and the lower surface 24 of the PCB 2. The enclosed frame body 6 is mounted on the PCB 2 to surround the corresponding LED lamps 4. The enclosed frame body 6 can be fixed on the PCB 2 by glue or other mains. The PCB 2 is inserted into the plug portion 1, and the extending beams 134 of the latch 13 are soldered on the metal bars 25 of the PCB 2.

Then the core wires 30 of the cable 300 are soldered and fixed on the rear end portion 22 of the PCB 2.

The metal shell 7 is assembled to the PCB 2 in the vertical direction, the first shell 71 is fixed to the second shell 72 by the latch tabs 711 being retained in the corresponding latch holes 721. The tongue portion 74 is fixed to the first rear end 152 of the mating shell 15 by soldering. The optical element 5 is mounted on the mating shell 5 along the front to rear direction until the through hole 51 abuts against the first transition portion 153 of the mating shell 15.

The cover 8 is assembled to the outside of the metal shell 7 and a front end of the optical element 5 is exposed to the cover 8 so that the cover 8 can be fixed to the optical element 5 and metal shell 7 by gluing or other manners. Thus, the assembly of the cable connector assembly 100 is completed. However, the assembly sequence of the cable connector assembly 100 is not unique, the maker can make adaptations as needed.

It is to be understood, however, that even though numerous characteristics and advantages of the present invention have been set forth in the foregoing description, together with details of the structure and function of the invention, the disclosure is illustrative only, and changes may be made in detail, especially in matters of shape, size, and arrangement of parts within the principles of the invention to the full extent indicated by the board general meaning of the terms in which the appended claims are expressed.

What is claimed is:

1. A cable connector assembly comprising:

an electrical connector including a plug portion, a printed circuit board (PCB) electrically connected to the plug portion and fixed at a rear end of the plug portion, a Light Emitting Diode (LED) lamp mounted on the PCB, a metal shell enclosing the PCB and having a receiving hole, and an optical element disposed on the plug portion in front of the LED lamp; and a cable electrically connected with the electrical connector; wherein the LED lamp has a curved sidewall facing the optical element and a rear sidewall facing the cable, an upper end of the LED lamp extending through the receiving hole of the metal shell.

2. The cable connector assembly as described in claim 1, wherein the electrical connector further includes a frame body surrounding the sidewalls of the LED lamp and enclosed by the metal shell.

3. The cable connector assembly as described in claim 1, wherein the metal shell is bent to form a light barrier behind the receiving hole, the light barrier reflecting light emitted by the rear sidewall of the LED lamp forwardly toward the optical element.

4. The cable connector assembly as described in claim 3, wherein the receiving hole is profiled to conform with a peripheral shape of the LED lamps.

5. The cable connector assembly as described in claim 4, wherein the rear sidewall of the LED lamp lies in a plane perpendicular to the PCB.

6. The cable connector assembly as described in claim 5, wherein the receiving hole has a curved edge fitting tightly with the curved sidewall of the LED lamp and a straight edge fitting tightly with the rear sidewall of the LED lamp to reduce the gaps between the LED lamp and the receiving hole.

7. The cable connector assembly as described in claim 1, wherein the electrical connector further includes another LED lamp, and the LED lamps are symmetrically arranged on an upper surface and a lower surface of the PCB.

8. The cable connector assembly as described in claim 7, wherein the plug portion includes an insulative housing, a plurality of conductive terminals received in the insulative housing, and a mating shell disposed outside of the insulative housing.

9. A cable connector assembly comprising:

an insulative housing defining a mating cavity;

a plurality of contacts disposed in the housing with contacting sections exposed in the mating cavity forwardly communicating with an exterior in a front-to-back direction;

a metallic front shell enclosing the housing;

a light waveguide positioned upon the front shell;

a printed circuit board located behind the housing and electrically and mechanically connected to the contacts around a front region thereof;

a cable mechanically and electrically connected to a rear region of the printed circuit board;

an LED (Light Emitting Diode) lamp positioned upon the printed circuit board between the front region and the rear region;

a metallic rear shell enclosing the printed circuit board;

a receiving hole formed in the rear shell; and a boot enclosing the rear shell; wherein said LED lamp extends through the receiving hole with an end exposed in a space between the rear shell and the boot to forwardly communicate with the light waveguide so as to have light, which is generated by the LED lamp, spread to the exterior via said light waveguide.

10. The cable connector assemble as claimed in claim 9, further including another LED lamp cooperating with said LED lamp to be positioned upon two opposite surfaces of the printed circuit board to respectively optically couple with the light waveguide along the front-to-back direction.

11. The cable connector assembly as claimed in claim 9, wherein the rear shell provides a light barrier intimately located behind the receiving hole and extending into the space so as to direct light toward the light waveguide forwardly in a front-to-back direction.

12. The cable connector assembly as claimed in claim 9, further including a frame body located between the printed circuit board and the rear shell to surround the LED lamp for preventing light escaping.

13. The cable connector assembly as claimed in claim 9, wherein said boot seals the space for preventing light transmission except through said light waveguide.

14. The cable connector assembly as claimed in claim 13, wherein the light waveguide surrounds the front shell.

15. The cable connector assembly as claimed in claim 14, wherein the boot have a similar circumferential dimension and configuration in a coplanar manner but with two different axial dimensions.

16. The cable connector assembly as claimed in claim 9, wherein said optical element is forwardly exposed to the exterior.

17. A cable connector assembly comprising:

an insulative housing defining a mating cavity;

a plurality of contacts disposed in the housing with contacting sections exposed in the mating cavity forwardly communicating with an exterior in a front-to-back direction;

a metallic front shell enclosing the housing;

a printed circuit board located behind the housing and electrically and mechanically connected to the contacts around a front region thereof;

a cable mechanically and electrically connected to a rear region of the printed circuit board;

an LED (Light Emitting Diode) lamp positioned upon the printed circuit board between the front region and the rear region;

a metallic rear shell enclosing the printed circuit board;

a receiving hole formed in the rear shell;

a boot enclosing the rear shell; and a light waveguide located in front of the LED lamp and around a front portion of the boot; wherein said LED lamp extends through the receiving hole with an end exposed in a space between the rear shell and the boot to forwardly communicate with the light waveguide so as to have light, which is generated by the LED lamp, spread to the exterior via said light waveguide.

18. The cable connector assemble as claimed in claim 17, wherein said light waveguide is forwardly exposed to the exterior.

19. The cable connector assembly as claimed in claim 18, wherein said light waveguide surrounds the front shell.

20. The cable connector assembly as claimed in claim 19, wherein said light waveguide and the boot have a similar circumferential configuration and dimension while with different axial dimensions.

* * * * *